United States Patent [19]

Crumb et al.

[11] 4,185,693

[45] Jan. 29, 1980

[54] OIL SHALE RETORTING FROM A HIGH POROSITY CAVERN

[75] Inventors: Robert E. Crumb, S.P.L.A.J., Libya; William L. Martin, Ponca City, Okla.; Gary C. Young, Visalia, Calif.

[73] Assignee: Conoco, Inc., Ponca City, Okla.

[21] Appl. No.: 913,406

[22] Filed: Jun. 7, 1978

[51] Int. Cl.[2] ..... E21B 43/24; E21B 43/26

[52] U.S. Cl. ..... 166/259; 166/263; 166/272; 166/299; 299/17

[58] Field of Search ..... 166/256, 259, 263, 271, 166/272, 298, 299, 303, 306, 307, 308; 299/13, 17; 102/23

[56] References Cited

U.S. PATENT DOCUMENTS

| | | | |
|---|---|---|---|
| 3,113,620 | 12/1963 | Hemminger | 166/259 X |
| 3,233,668 | 2/1966 | Hamilton et al. | 166/259 |
| 3,316,020 | 4/1967 | Bergstrom | 166/259 X |
| 3,434,757 | 3/1969 | Prats | 299/13 X |
| 3,730,270 | 5/1973 | Allred | 166/299 X |
| 3,957,306 | 5/1976 | Closmann | 166/272 X |
| 3,999,607 | 12/1976 | Pennington et al. | 166/259 |
| 4,015,664 | 4/1977 | Acheson et al. | 299/13 X |
| 4,091,869 | 5/1978 | Hoyer | 166/259 |
| 4,092,045 | 5/1978 | Sullivan | 299/17 |
| 4,109,719 | 8/1978 | Martin et al. | 166/259 |
| 4,113,313 | 9/1978 | Terry | 166/256 X |

FOREIGN PATENT DOCUMENTS

| | | | |
|---|---|---|---|
| 697189 | 9/1953 | United Kingdom | 166/259 |

*Primary Examiner*—Stephen J. Novosad
*Assistant Examiner*—George A. Suchfield
*Attorney, Agent, or Firm*—Cortlan R. Schupbach, Jr.

[57] ABSTRACT

A method of producing hydrocarbonaceous liquids and gases from subterranean kerogen-containing oil shale formations comprising (a) penetrating the oil shale deposits with at least two well bores; (b) fracturing the oil shale deposits in a lower vertical portion thereof; (c) igniting the hydrocarbonaceous deposit; (d) introducing through the first well bore a free oxygen-containing gas to the ignited point of the oil shale deposit to effect thermal decomposition of the hydrocarbonaceous material therein and to propagate a combustion zone through the fractured communication area and the second well bore, thereby forming a region of combusted shale between the first well bore and the second well bore; (e) allowing the combustion to continue until a sufficient volume of combusted shale has been formed; (f) then jetting an aqueous liquid into and through the combusted shale zone to remove the mineral residue remaining after combustion; (g) positioning conventional explosives in the oil shale deposit in the vicinity of the washed-out cavity formed in step (g) above; (h) detonating the explosives, thereby causing the oil shale deposit to be fragmented and to collapse into the cavity, thus creating a rubblized zone of relatively high permeability and porosity; (i) then igniting the oil shale and introducing a free oxygen-containing gas at the top of the rubblized zone to combust and retort the rubblized hydrocarbonaceous deposit. Alternatively, a heated liquid may be introduced at a temperature of from around 700° to 1000° F. to effect production of hydrocarbonaceous liquids or gases from the rubblized oil shale.

9 Claims, 4 Drawing Figures

OILE SHALE RETORTING FROM A HIGH POROSITY CAVERN

This invention relates to an improved method for recovering hydrocarbonaceous values from underground shale oil deposits. More particularly, this invention provides a method for recovering hydrocarbonaceous values from underground shale deposits by a method of drilling, fracturing, igniting, slurry mining, explosively rubblizing, and retorting the rubblized zone thus formed.

As the world supply of fluid hydrocarbons decreases and becomes increasingly expensive and difficult to recover, attention has turned to the immense reserves of subterranean hydrocarbonaceous deposits of shale oil known to exist throughout the world. However, in shale oil deposits recovery methods currently in use are not competitive with natural petroleum or gas sources, even considering the increasing scarcity of the latter. Extensive development projects have been conducted to devise economic methods of recovering hydrocarbonaceous values from such deposits. Initial methods applied to oil shale involved the mining of the oil shale transporting the mined shale to the surface, crushing, grinding, passing through a retort to volatilize the oil content followed by discarding the spent shale. This procedure is quite clearly expensive and has many inherent technical problems. The procedure, although effective, remains economically unattractive even today.

Insitu retorting has been proposed using several general approaches. High explosives have been proposed to establish communication between adjacent wells drilled into a formation. The pressure drop is high and utilization of the complete formation extremely difficult. Another approach is described in U.S. Pat. Nos. 3,001,776 and 3,434,757 wherein a tunnel is formed under the oil shale deposit usually with conventional mining techniques. The resultant roof support is removed and the overlying shale allowed to cave or alternatively is caved by explosives. Following this caving, a large volume of rubble remains in a loosly filled cavern. This rubble is then rotorted. However, horizontal retorting as is necessary in a tunnel system generally leaves much oil shale uncombusted and the hydrocarbon values largely unrecovered.

Oil in oil shale is present in the form of a solid material referred to as "kerogen". Oil shale is frequently found in deposits at depths sufficient to prelude the use of strip mining methods. At times the deposits are very thick, for example up to 2,000 feet, and not suitable for mining by conventional underground mining methods. For example, if room and pillar mining such as used in coal mining should be employed, the pillars left to support the ceiling cause a large part of the shale in the deposit to be left in place when the mining is completed and is subsequently unrecoverable. In addition, much of the deep shale contains active aquifers, making mining hazardous. Mechanical mining operations in which the shale is blasted into an underlying chamber by explosives is described in U.S. Pat. No. 3,466,094. However, a substantial part of the shale is left in the formation, and in any event it is necessary to proceed the shot hole drilling with expensive conventional mining operations.

In-Situ retorting has been reported in U.S. Pat. Nos. 1,422,204; 3,753,594; 3,578,080; 3,661,423; 2,695,163; and 3,316,028. These references generally teach drilling a plurality of bore holes into the shale deposit and detonating explosives in the bore holes to form fractures providing communication between the bore holes. Steam or hot combustion gases are then circulated through the crack from one bore hole to another to heat the shale to a temperature sufficient to cause decomposition of the kerogen and drive volatile carbonization products to the surface through the bore holes. However, oil shale has a very low permeability and the fracturing caused by detonating explosives in a bore hole will not provide sufficient communication from that bore hole to an adjacent bore hole for effective retorting of the shale. Generally the shale oil that is retorted from the works adjacent to any fracture formed by the explosion is immediately decomposed and/or combusted by the hot gases passing through the fracture. Thus, the recovery of useful products by such a procedure is very low. Attempts to solve these problems can be found in U.S. Pat. Nos. 3,661,423 and 3,316,020 which provide broken shale but still require mining-type operations. Elimination of mining is proposed in U.S. Pat. No. 3,001,776 wherein a plurality of vertical cylindrical chambers are formed by drilling bore holes and detonating explosives. However, the vertical chambers are separated by columns of shale which are not retorted. Only very low void volumes are provided by drilled well bores. The resulting rubblized zones are relatively small and much of the affected volume is only fractured, not rubblized. As a consequence a substantial part of the oil in the shale deposit cannot be recovered as set forth above.

U.S. Pat. No. 4,015,664 proposes an in-situ combustion process whereby shale is rubblized by relief blasting from shot holes drilled from the surface of the ground into a free space consisting of a 5 foot diameter under reamed wellbore in the shale deposit, thus providing room for expansion of the explosive volume. The shale is retorted in-situ to remove organic material from the shale and provide additional "free volume". Sequentially, second shot holes are drilled from the surface into the shale deposit laterally from the retorted area and shale is blasted from the vicinity of the second shot holes into the retorted zone. These steps are repeated to move the retorting zone laterally across the shale deposit. However, the porosity created by wellbore blasting in rock at any significant depth is severely limited, and when retorted, shale, unlike coal, leaves a substantial amount of mineral ash behind which essentially fills all of any cavity initially created. Kerogen is vaporized from intergranular porosity, which leaves only micro void space behind such retorting and much of the spent shale remains as semi-consolidated or consolidated porous rock. This spent shale thus effectively eliminates free void space and subsequent blasts are not provided the void volume necessary to obtain effective rubblization.

It would therefore be of great benefit to provide an in-situ retorting method whereby mining could be eliminated and sufficient free volume regenerated to allow subsequent blasting and substantially complete recovery of all of the shale oil in the rock retorted.

It is therefore an object of the present invention to provide a method for more complete recovery of oil from shale deposits without the necessity of mining.

The present invention provides a method for producing hydrocarbon liquids and gases from subterranean kerogen-containing formations by sequentially (a) penetrating the oil shale deposits with at least 2 well bores, designating a first well bore and one or more second well bores; (b) fracturing the oil shale deposits so as to provide communication between the first well bore and the second well bore in a lower vertical portion thereof; (c) igniting the deposit at a point near the first well bore in the presence of a free oxygen-containing gas; (d) introducing through the first well bore a free oxygen-containing gas to the ignited point of the oil shale deposit to effect thermal decomposition of the hydro-carbonaceous material therein and to propagate a combustion zone through the fractured communication area between the first well bore and the second well bore, thereby forming a region of combusted or spent shale between the first well bore and the second well bore; (e) allowing the combustion to continue until a sufficient volume of combusted shale has been formed between the two well bores; (f) then jetting an aqueous liquid into and through the combusted shale zone between the well bores to break up, suspend and remove the mineral residue remaining after the combustion of the kerogen in the oil shale; (g) positioning conventional explosives in the oil shale deposit in the vicinity of the washed-out cavity formed in step (g) so that the energy generated upon detonation of the explosive interacts with the free surface and extends into the cavity; (h) sequentially detonating the explosives, thereby causing the oil shale deposit to be fragmented and to collapse into the cavity formed, thus creating a rubblized zone of relatively high permeability and porosity; (i) then igniting the oil shale by heating and introducing a free oxygencontaining gas at the top of the rubblized zone by way of at least one of the well bores to combust and effectively retort the entire rubblized hydro-carbonaceous deposit. The combustion steps described in steps (a) through (e) can be accomplished using the steps described or as by a method known in the art as reverse combustion, where the flame front moves against the flow of air by means well known in the art, or by a combination of these methods. For reverse combustion $O_2$ containing gas is injected at the second wellbore during step (d) to effect reverse combustion, followed by forward combustion between the wells.

The invention is more completely described with reference to the drawings.

Generally, FIG. 1 is a side view of oil bearing shale (kerogen) formation with wells drilled and cased through the overburden therein and tubing strings penetrating the oil shale. The figure also shows a fracture zone resulting from employment of conventional fracturing techniques.

Figure 1:
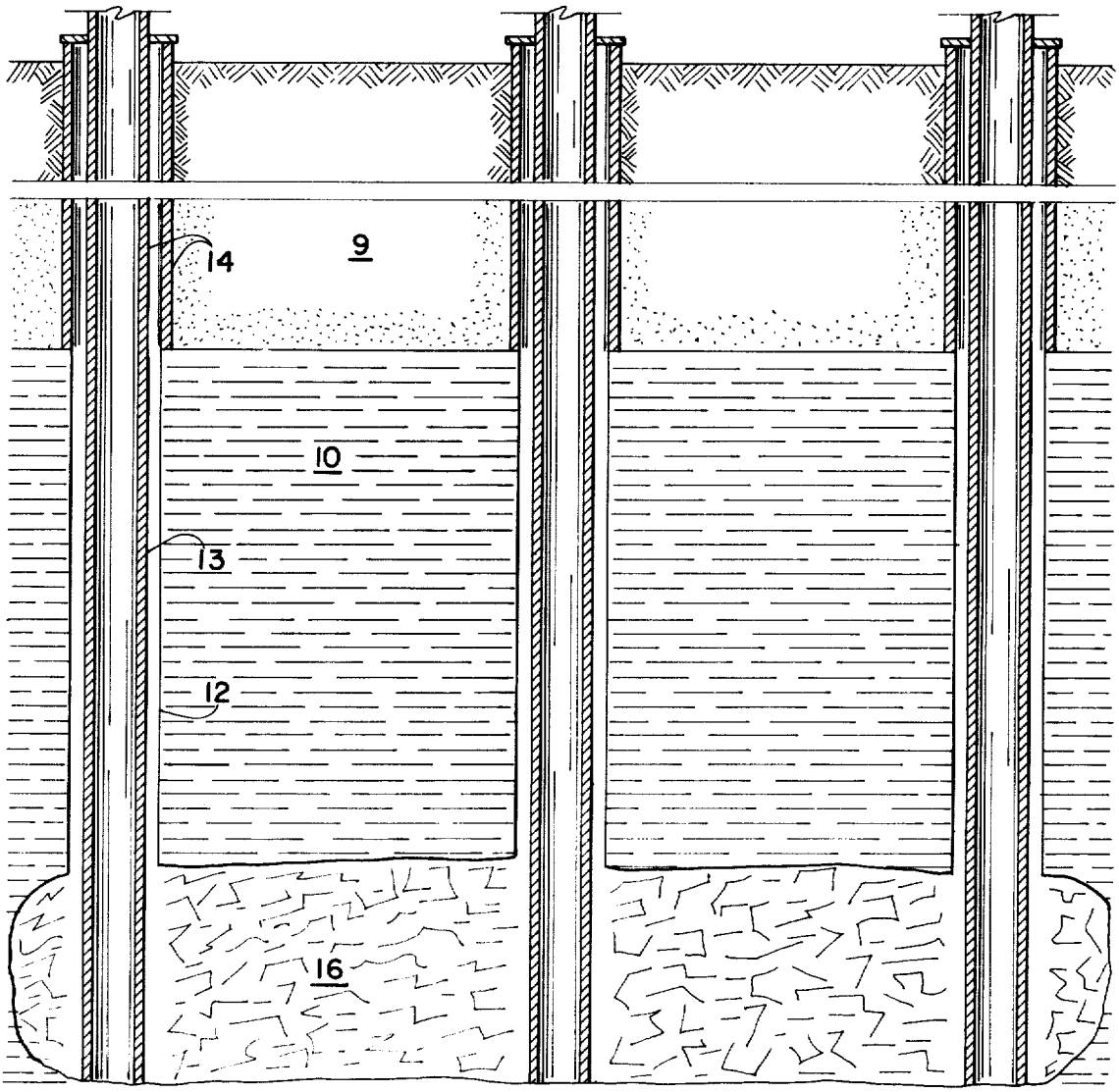

Referring to FIG. 1, a body of shale (10) as indicated underlies an overburden (9). Bore holes (12) are drilled from the surface through the overburden and into the oil shale. In the embodiment of the invention illustrated in FIG. 1 the bore hole does not necessarily extend all the way through the oil shale. These bore holes contain tubing strings (13) and are cased (14) as necessary and are fractured using conventional techniques well-known to those in the petroleum arts, such as by explosives or by hydraulic fracturing. However, it should be understood that any other method of obtaining fractures and/or communication between bore holes will be effective. The tubing string (13) is packed off (18) and perforated to form aperatures (20) by conventional means.

Once the fracturing (16) has been completed, a locus of the formation fractured is ignited, free oxygen-containing gas is pumped down a first bore hole, and the combustion is allowed to spread through the fractured zone to at least one second bore hole wherein the gases exit the formation. This combustion is continued until the fractured zone is considered to be substantially combusted and only spent shale remains.

The amount of organic material in shales most suitable for the production of oil ranges from about 20% of the volume of the original shale (yielding approximately 15 gallons of oil per ton of shale) to over 40% of the volume of the original shale (yielding about 40 gallons of oil per ton of shale). Any porosity formed in the fractured zone as the retorting proceeds only exists as micro voids and is not sufficient to provide free volume for blasting. However, the richer the shale the softer the spent shale will be after retorting.

Figure 2:
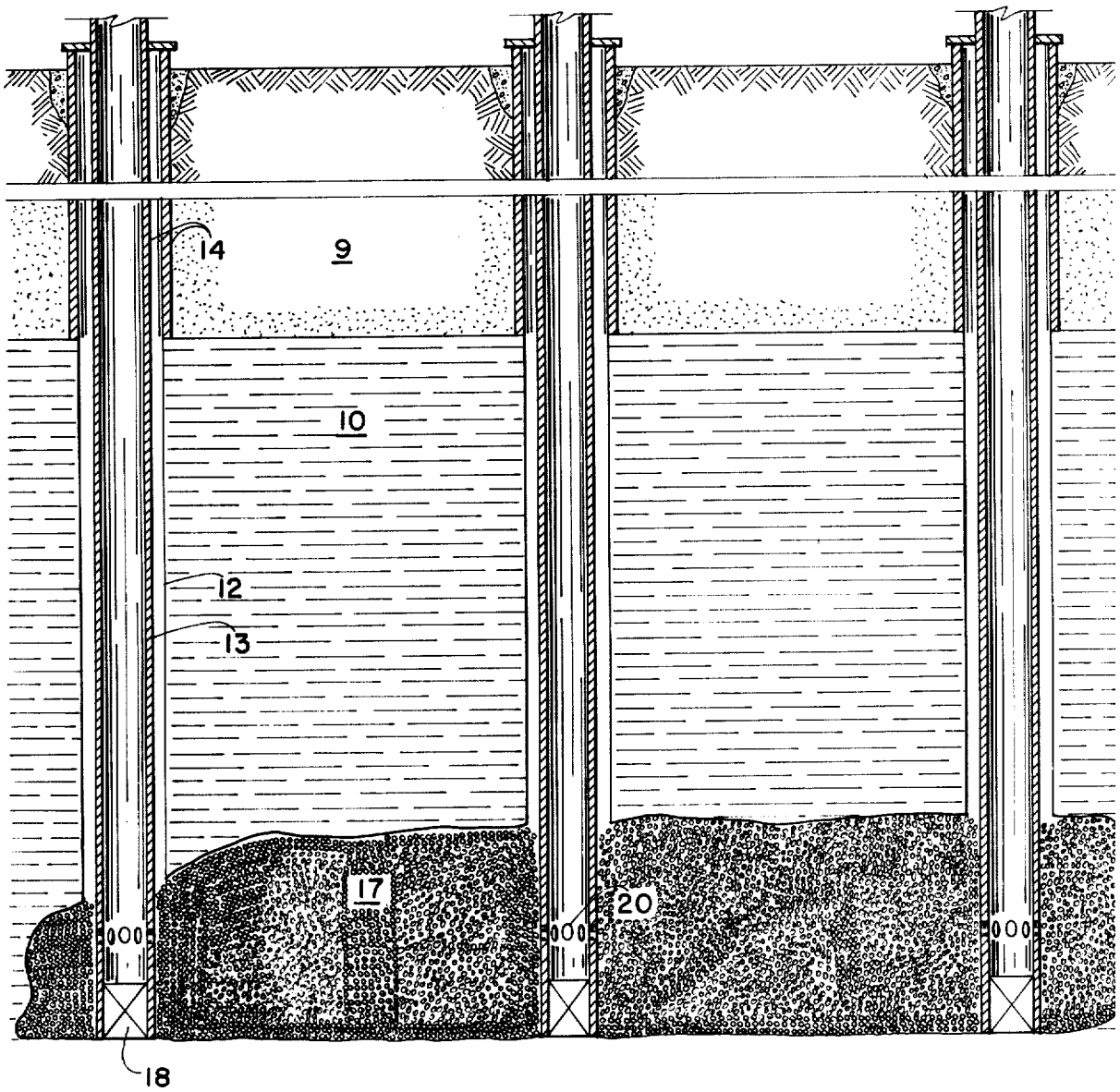
FIG. 2 is an illustration of the oil shale at the end of combustion of the fractured zone.

FIG. 2 illustrates the oil shale formation at the completion of the combustion of the fractured zone. At this point, a larger bore hole may be drilled from the surface through the overlying oil shale and into the combusted area. Normally this bore hole will be open hole from the overburden or beginning of the oil shale to the fractured area, and would be cased (14) from the surface to the oil shale. The preferred embodiment uses the existing wellbores in this step. Once the hole (12) has been bored into the fractured zone, the inner tubing (13) is run and packed off (18) for jetting. Water or other suitable fluid is then jetted against and through the formation. Fluid jets against the spent shale through aperatures (20) in the tubing string, such aperatures being optimally sized by means well known in the art. The resulting high pressure aqueous jets break up the combusted and spent shale (17) and drive it to the surface through the open hole and pipe casing, thus creating a void. The water can also contain materials to aid in removal of the retorted shale. Examples of such materials are acids such as HCl and $H_2SO_4$.

The washing can be carried out using a simple tubing string with an inner annulus. In this embodiment, the high pressure fluid is forced down the inner tube and exits up through the casing of the same wellbore to slurry mine the retorted shale. This method is similar to in-situ sulfur recovery and phosphate slurry mining techniques.

Figure 3:
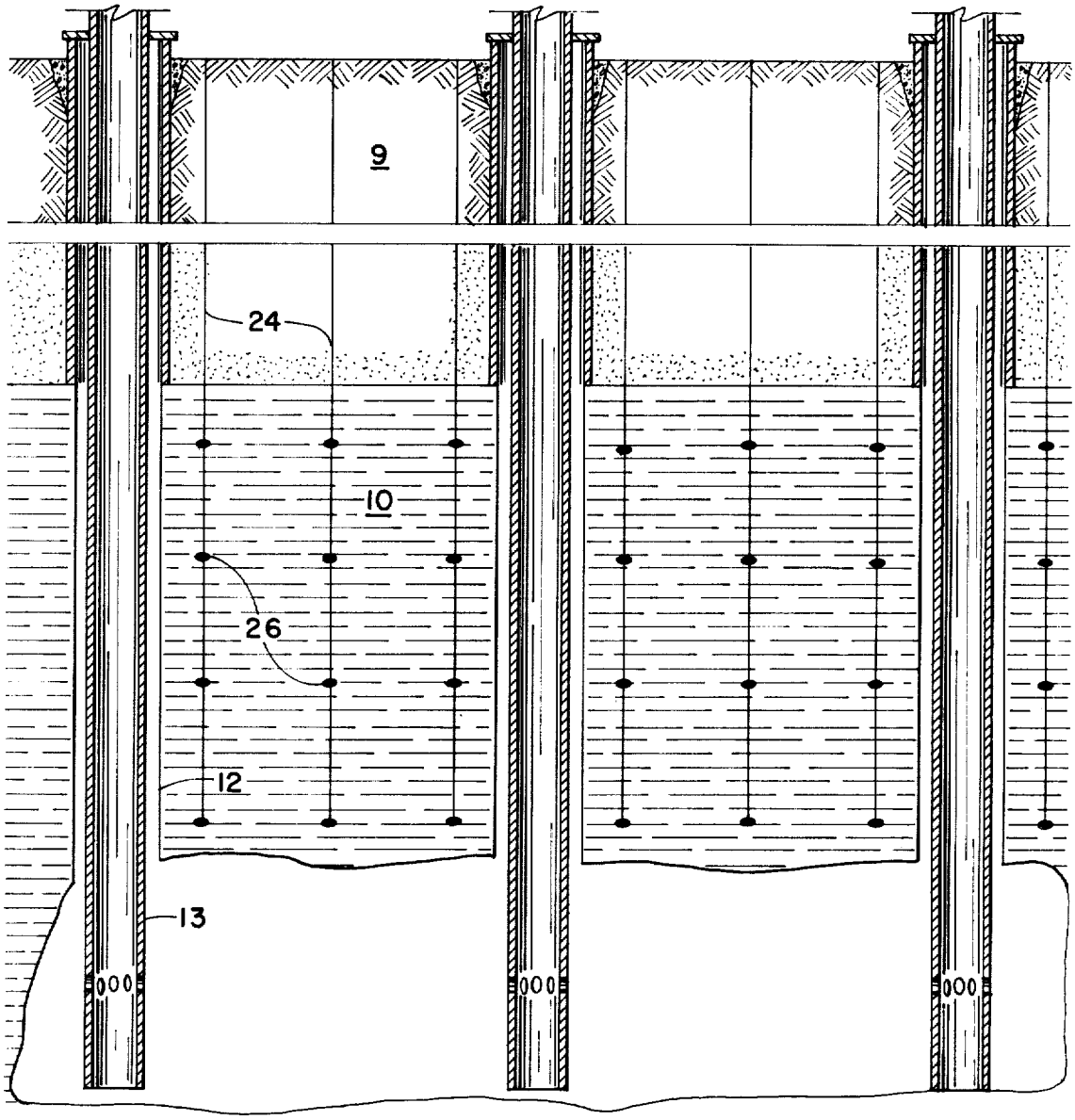
FIG. 3 is an illustration of the oil shale after the jetting and washing step, followed by drilling of chargeholes and insertion of sequential charges.

FIG. 3 shows the formation previously discussed at the conclusion of the jetting and washing step. The high pressure aqueous fluid has broken down and essentially formed a slurry of the combusted shale and moved it out to disposal on the surface. Shale is intrinsically hard prior to combustion and the surrounding non-combusted areas are not affected.

Any liquid or slurry remaining in the void volume at the conclusion of the jetting step is then removed by conventional techniques, such as pumping, or by gas lift. Once the void has been formed and the washing step completed, charge holes (24) are drilled from the surface into the area above the void formed in the previous steps. Sequential charges (26) are placed in these holes at various depths and are designed to rubblize the intended retort area of the shale. The figure shows tubing strings (13) remaining in the formation during the placing of the charges. These tubing strings can be optionally left in the formation during the rubblizing or they can be withdrawn during the rubblizing step and reinserted using standard drilling techniques at the conclusion of the blasting.

Figure 4:
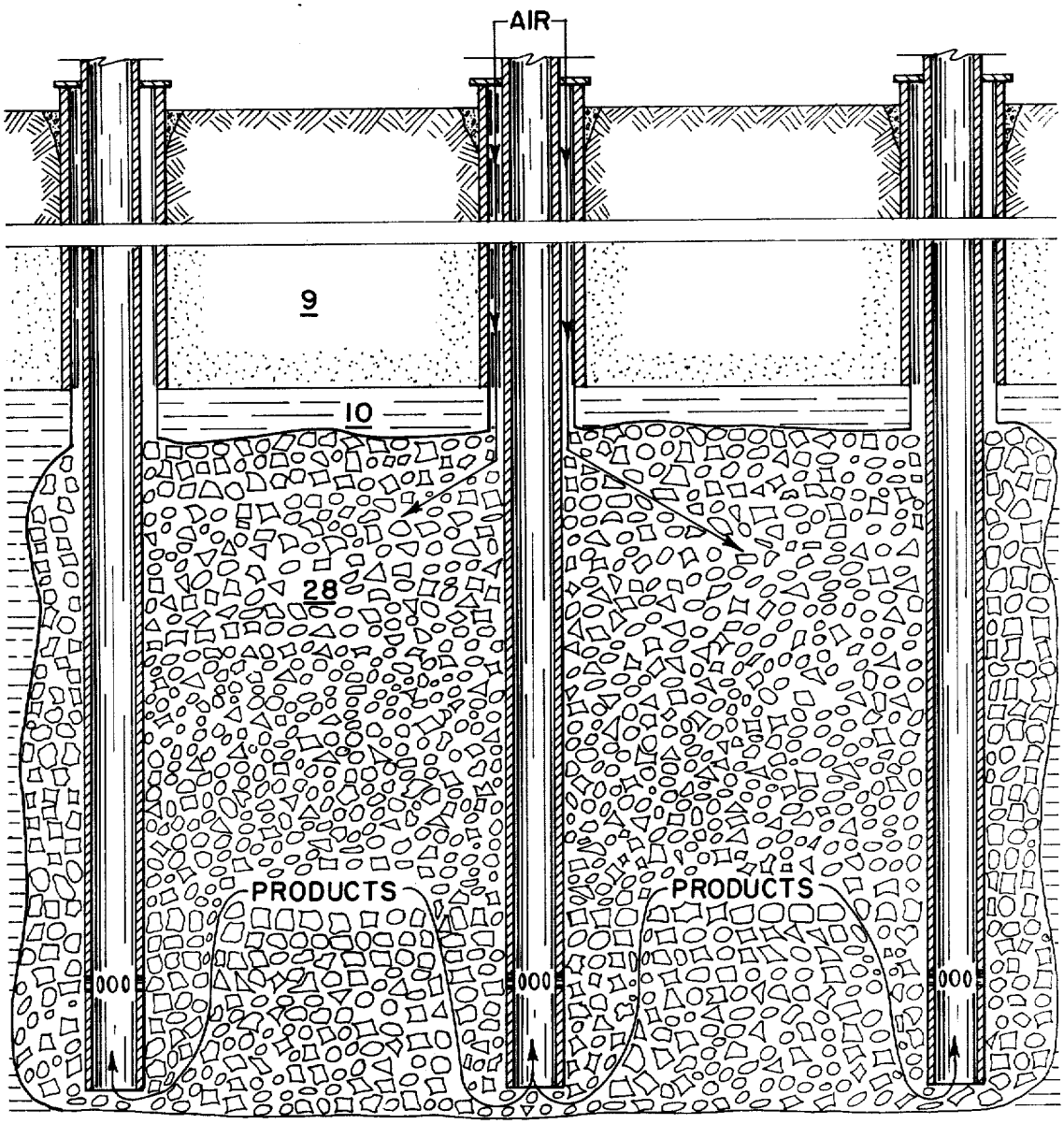
FIG. 4 shows the formation after charge detonation and before retorting of the rubblized zone resulting from the detonation of the sequential charges of FIG. 3.

FIG. 4 shows the formation previously described at the conclusion of the blasting. The rubblized zone (28) formed is preferably ignited near the top of the zone and a free-oxygen-containing gas such as air is injected to support a combustion front. The combustion front moves through the formation from top to bottom driving the liquid and gaseous components before it. These materials are then recovered through the tubing strings which have either been left in the formation or reinserted at the conclusion of the blasting step. These in-situ combustion techniques and conditions are well-known to those skilled in this art and are exemplified by U.S. Pat. Nos. 3,044,545; 3,578,080; and the U.S. Department of the Interior Bureau of Mines report as set forth in *Chemical Engineering Process*, volume 62, Number 8, hereby incorporated into this specification by reference.

In the case of an extremely thick oil shale formation it may be necessary to repeat the above process several times.

The removal of the combusted shale using the high-pressure water jets is done in a manner similar to that used for the mining of coal and other materials as described in Flow Research Presentation on the Hydraulic Borehole Mining of Coal in cooperation with the United States Bureau of Mines, given on July 20, 1976 at Wilkeson, Washington, and a second presentation at Caspar Wyoming, July 12, 1977. Another procedure is described in a paper entitled *Hydraulic Mining, Tunnel Boring aid Shaft Drilling Operations*, by R. F. Dewey, presented at the Intermountain Symposium on Fossil Hydrocarbons, Oct. 9 and 10, 1964, at Salt Lake City, Utah. Water is the aqueous liquid of choice since it is less expensive and more plentiful than any other. The water can contain other materials, such as acids, to facilitate the slurrying and removal of the combusted shale.

The fracturing step initially described can be carried out by any one of several means such as hydraulic or explosive fracturing. An acceptable method can be found described in *Petroleum Engineer*, Nov. 1977, pages 31–42. Other methods are well known to those skilled in this art. The initial wells are drilled on spacings that would give convenient well to well fracturing. Bore hole centers would normally be on the order of 10 to 200 feet.

At the conclusion of the initial retorting step, well bore hydraulic jetting is used to remove the spent ash from the combusted area thus creating void areas and free faces. These free faces will greatly increase the effectiveness of later blasting. Energy waves from blasting will be reflected at the free face, thereby creating tensil fracturing or spalling. The tensile strength of oil shale is on the order of 500 pounds per square inch gauge, while the compressive strength is approximately 16,000 pounds per square inch. Thus more then 30 times as much energy is required to break oil shale by compressive loading around a bore hole than it does by to break it by spalling at a free face even without considering impact loading. Thus the creation of void volume and free face surface is a very significant improvement over single well bore blasting.

Following the creation of the void volume the shale above the void and between the bore holes is blasted. Usually charge hole (24) centers of 5 to 60 feet are used, more preferably 10 to 20 feet. Explosive charges are segregated and spaced vertically (26) so they can be sequentially detonated against free surfaces moving vertically from the original void volume.

At the conclusion of the blasting, production wells are drilled to the bottom of the in-situ retort area, old blast holes being re-entered and reused if available, or new wells drilled directionally to the base of the retort. If the retort area is not contacted by these wells, a small amount of explosive at the base of the new wells easily connects the new wells to the rubblized volume to be retorted.

Finally the rubblized oil shale is ignited and retorted in-situ using procedures well-known to those skilled in the art. Alternatively, a heated fluid can be used. Examples of suitable fluids are $CO_2$, methane, and superheated steam at temperatures of from about 700° F. to about 1000° F.

Thus it can be seen that in the preferred embodiment of this invention, as illustrated in the figures, an entire shale deposit can be treated without requiring mechanical mining steps, while recovering a major portion of the shale oil without requiring support of the overburden. Void spaces are easily created by means of the high pressure water jets and consequently filled with shale rubble formed by conventional explosives. Utilizing only surface facilities such as drill rigs, the inherent dangers of underground mining such as blasting and drilling are avoided. Exotic equipment is not required and oil in the shale can be recovered to a large extent.

Shale oil and gas from the in-situ combustion of the oil shale is recovered through bore holes which were originally drilled for fracturing, although in the rubblized zone such holes may have to be reformed due to the effects of blasting. These bore holes provide convenient means of recovery of the desired hydrocarbon products or the injection of air during combustion.

While certain embodiments and details have been shown for the purpose of illustrating this invention, it will be apparent to those skilled in this art that various changes and modifications may be made herein without departing from the spirit or the scope of the invention.

We claim:

1. A method of producing hydrocarbonaceous liquids from subterranean kerogen-containing oil shale formations covered by an overburden comprising sequentially (a) penetrating the oil shale deposits with at least two well bores, designating a first well bore and at least one second well bore; (b) fracturing the oil shale deposits so as to provide communication between the first well bore and the second well bores in a lower vertical portion thereof: (c) igniting the hydrocarbonaceous deposit at a point near the first well bore in the presence of a free oxygen-containing gas; (d) introducing through the first well bore a free oxygen-containing gas to the ignited point of the oil shale deposit to effect thermal decomposition of the hydrocarbonaceous material therein and to propagate a combustion zone through the fractured communication area between the first well bore and the second well bore, thereby forming a region of combusted shale between the first well bore and the second well bore; (e) allowing the combustion to continue until a sufficient volume of combusted shale has been formed between the two well bores; (f) then jetting an aqueous liquid into and through the combusted and spent shale zone to remove the mineral residue remaining from the combustion of the kerogen in the oil shale; (g) positioning conventional explosives in the oil shale deposit in the vicinity of the washed out cavity formed in step (g) such that the energy generated upon detonation of the explosive interacts with and extends into the cavity; (h) detonating the explosives thereby causing the oil shale deposit to be fragmented and to collapse into the cavity creating a rubblized zone of relatively high permeability and porosity; (i) then igniting the oil shale by heating and introducing a free-oxygen-containing gas at the top of the rubblized zone by way of one of the well bores to combust and retort the rubblized carbonaceous deposit.

2. A method as described in claim 1 wherein step (i) alternatively introduces a heated fluid to effect the production of carbonaceous liquids or gases from the rubblized oil shale.

3. A method as described in claim 2 wherein the heated fluid is selected from the group consisting of methane, $CO_2$, and superheated steam.

4. A method as described in claim 3 wherein the fluid is at a temperature of from about 700 to about 1200° F.

5. A method as described in claim 1 wherein step (b) is hydraulic fracturing, explosifracturing, or well bore blasting using conventional explosives.

6. A method as described in claim 1 wherein the aqueous liquid is water.

7. A method as described in claim 6 wherein the aqueous liquid is water containing materials selected from the group consisting of inorganic acids, HCl and $H_2SO_4$.

8. A method as described in claim 1 wherein steps (a) through (i) are repeated at the conclusion of step (i).

9. A method as described in claim 1 wherein $O_2$ containing gas is injected at the second wellbore during step (d) to effect reverse combustion followed by forward combustion between the wells.

* * * * *